US006823635B2

(12) United States Patent
Schulze et al.

(10) Patent No.: US 6,823,635 B2
(45) Date of Patent: Nov. 30, 2004

(54) WELDMENT PLATE SPACER/SUPPORT

(76) Inventors: Todd M. Schulze, 8282 McKee Rd., Albion, PA (US) 16401; Clayton E Schulze, 8282 McKee Rd., Albion, PA (US) 16401

( * ) Notice: Subject to any disclaimer, the term of this patent is extended or adjusted under 35 U.S.C. 154(b) by 298 days.

(21) Appl. No.: 09/777,400

(22) Filed: Feb. 6, 2001

(65) Prior Publication Data

US 2002/0104285 A1 Aug. 8, 2002

(51) Int. Cl.[7] ..... E04C 3/16

(52) U.S. Cl. ..... 52/365; 52/677; 52/676; 52/372; 52/514

(58) Field of Search ..... 52/677, 678, 365, 52/372, 514

(56) References Cited

U.S. PATENT DOCUMENTS 1,578,947 A * 3/1926 Alber ..... 52/678

3,333,380 A * 8/1967 Wolf ..... 52/677

* cited by examiner

*Primary Examiner*—Carl D. Friedman
*Assistant Examiner*—Nahid Amiri
(74) *Attorney, Agent, or Firm*—Dennis G. LaPointe; Mason Law, P.L.

(57) ABSTRACT

A spacer/support having a body portion, a surface engaging portion and a securement to attach the body portion to a weldment plate in tilt-up construction is disclosed. In a first embodiment, the securement includes a plurality of fingers that can snap onto the head of a Nelson stud. A second embodiment is equipped with a flat head that can be secured to the weldment plate using an adhesive. The length of the spacer/support may be adjusted manually by cutting the body to length or by rotating one threaded member relative to a second to accommodate different thicknesses of walls. The spacer/support is preferably plastic but may be metal.

28 Claims, 4 Drawing Sheets

WELDMENT PLATE SPACER/SUPPORT

BACKGROUND AND SUMMARY OF THE INVENTION

The present invention relates to the manufacture of concrete walls used in tilt-up construction. More particularly, the present invention is directed to a spacer/support that holds a weldment plate in proper position until the wet concrete sets up.

In commercial construction, as well as in residential construction where wood is at a premium, builders are increasingly using tilt-up construction, that is, they are pouring concrete walls in forms as they lay on the ground, floor or other surface, and then tilting them up into the desired position after the concrete has cured. One of the features such construction affords is the placement of a weldment plate on one surface of the wall so that structural support beams, and the like, may be welded/secured between adjacent walls. In current practice, the concrete wall is poured and then the weldment plate is "floated" on the top of the wet cement. Since these Steel plates are denser than the wet concrete, they tend to sink below the surface. Accordingly, it sometimes becomes necessary to allow the concrete to take a partial set and then attempt to push the weldment plate into the desired position. Neither of these current practices provides effective quality control and the results often are not those desired.

The device of the present invention comprises a spacer/support that engages the support surface on which the concrete wall is poured and a weldment plate holding it in the desired position relative to that surface during the curing of the concrete. The spacer/support comprises a elongate body portion having a length substantially equal to the thickness of the concrete wall minus a dimension of the weldment extending in the direction of the thickness of the concrete wall; a surface engaging portion for contacting the surface on which the concrete wall is poured and supporting the weldment in a position appropriately spaced from that surface; means for attaching said body portion to the weldment; whereby the weldment will be maintained in a desired position as wet concrete is poured and sets up.

Weldment plates take different forms: some are simply rectangular metal plates with two smooth surfaces. Other weldment plates are equipped with protrusions on one surface that improve the adhesion of the plate to the wall enabling greater weight to be suspended therefrom. These protrusions typically take the form of a plurality of Nelson studs welded to the surface of the plate that is to be embedded in the concrete. These studs can have shaft diameters of ¼", ⅜", ½", ⅝" with head diameters graduated by ¼ increments between ½" and 1¼". For weldment plates that have no protrusions, the support/spacer will have additional length (as compared to those engaging the heads of Nelson studs) and be equipped with a flat head that can be adhered to the nether surface of the weldment plate by an adhesive such as LIQUID NAILS (a registered trademark of Macco). A minimum of three spacer/supports will be used on each weldment plate positioned in a triangular pattern to provide balance in the wet concrete. The embodiment of support/spacer engaging the Nelson stud will have a plurality (three shown) of fingers that grip the head of the stud, the fingers having portions that snap beneath the head and retain the spacer/support in position while the concrete sets up. This configuration will be made in a plurality of sizes to accommodate the various sizes of Nelson stud heads.

The spacer/support is preferably made of a material selected from the group consisting of plastic, metal, and powdered metal. The end contacting the support is preferably pointed to minimize the surface treatment needed for the wall and, typically, the wall may simply be painted, papered or given any other conventional treatment, without the tips of the spacer/supports affecting the treatment. The length of the body portion of the spacer/support may be adjusted in either of two ways: the surface may be scored at any of a plurality of conventional lengths, and the spacer/support cut to the length appropriate for the wall thickness with which it is used; the spacer/support includes two parts that may be adjusted relative to each other to achieve the desired length. Preferably, these pieces are threadingly engaged and the length can be readily adjusted by rotating one of the pieces relative to the other. This feature may be added to either the flat-head or fingered configurations.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(s)

Figure 1:
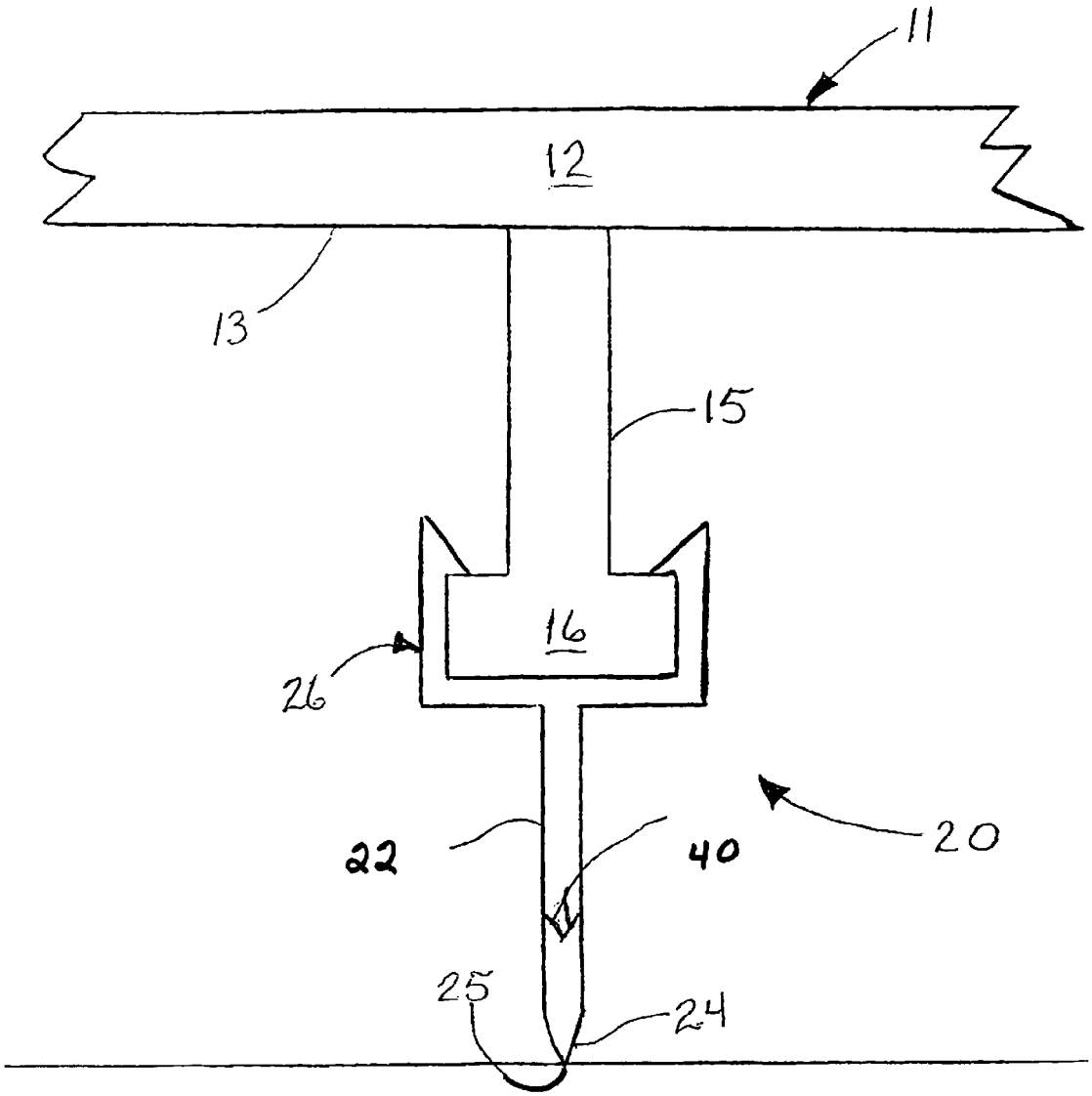
FIG. 1 is a side view of a first embodiment of the weldment spacer/support of the present invention shown assembled on a Nelson stud.
Figure 2A:
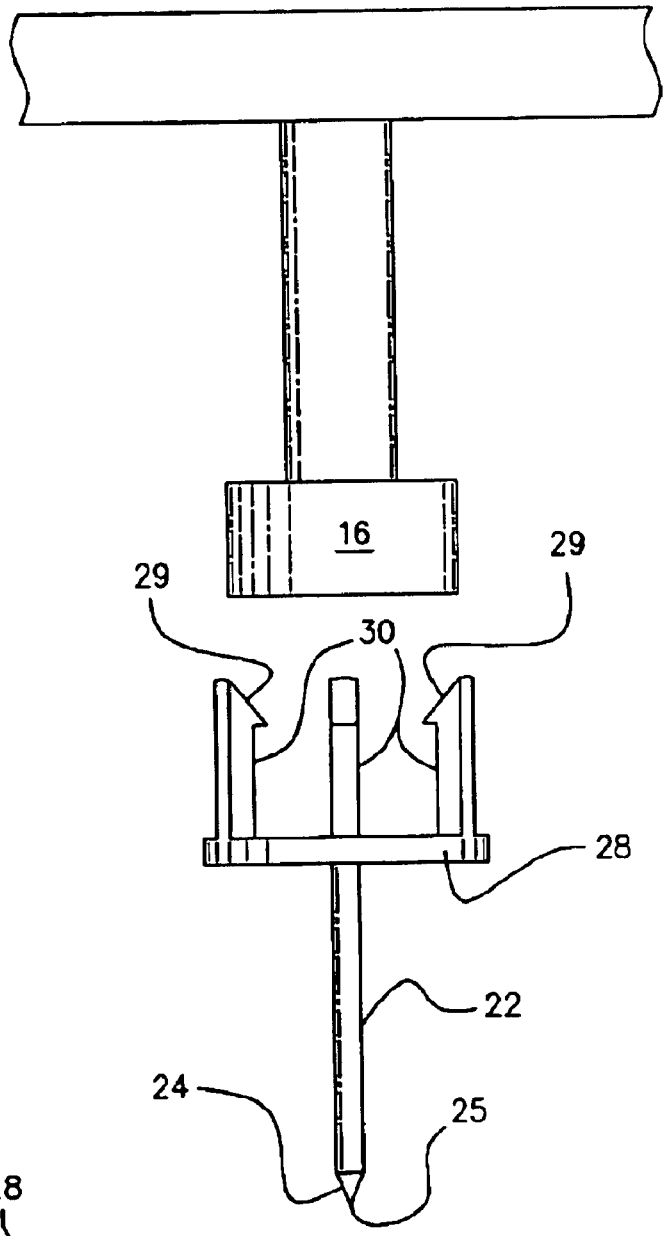
FIG. 2A is an exploded side view of the spacer/support shown in FIG. 1.
Figure 2B:
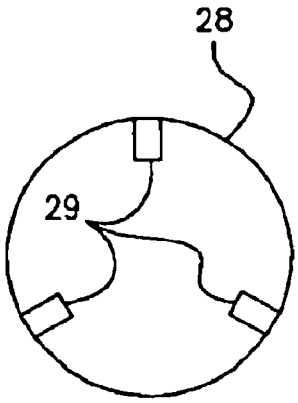
FIG. 2B is a top view of the first embodiment.
Figure 3:
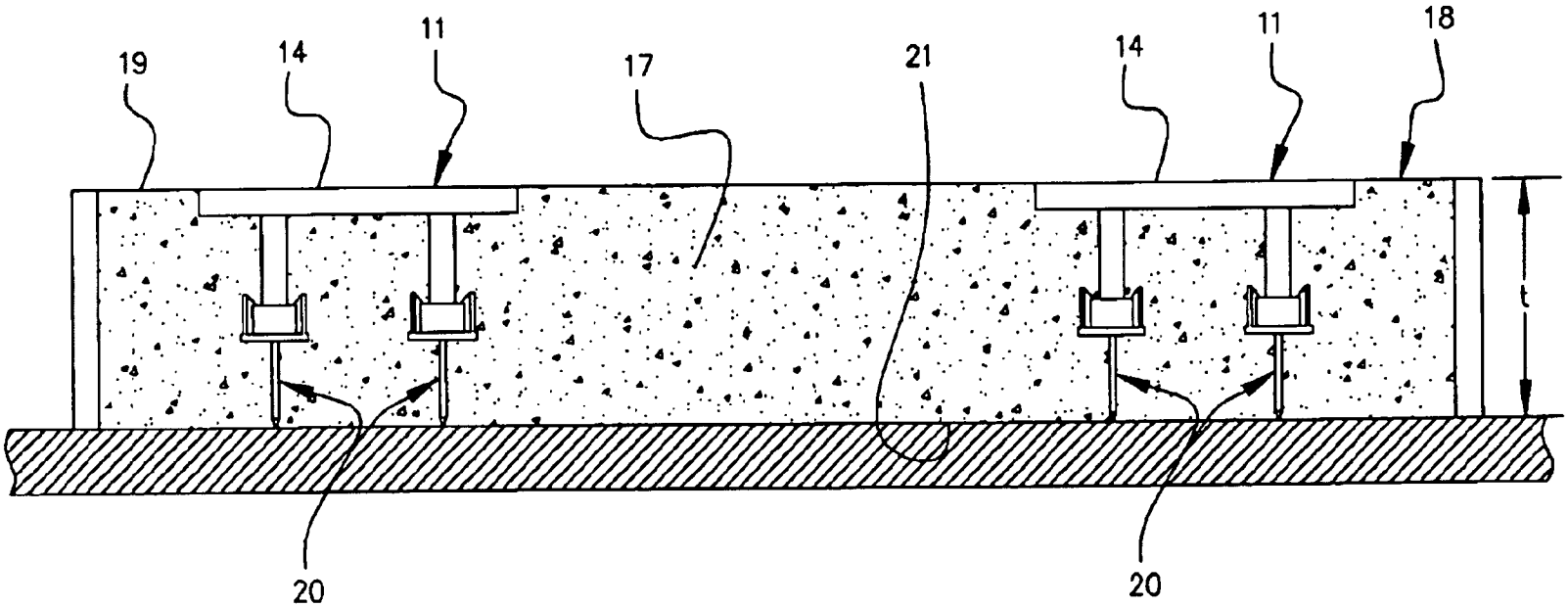
FIG. 3 is a schematic view showing the spacer/supports used to suspend a pair of weldment plates on a tilt-up wall.

A first embodiment of the weldment plate spacer/support is shown in FIGS. 1–3 generally at 20. Weldment spacer/support comprises an elongated body portion 22, a surface engaging portion 24, and means 26 for attaching the spacer/support to weldment plate 11. In this embodiment, weldment plate 11 includes projections 15 which may take the form of Nelson studs welded to the surface 13 of weldment plate 11 to be embedded in the concrete 17 (FIG. 3). Body portion 22 is of a length substantially equal to the thickness t of the concrete wall 18 minus a dimension of the weldment plate 11 extending in a direction of the thickness of the concrete wall 18. In this case, the dimension of the weldment plate extending in the direction of the thickness of wall 18 includes the thickness of plate 12 as well as the length of Nelson stud 15. Nelson studs come in a plurality of sizes and lengths. Common diameters include ¼", ⅜", ½41 , ⅝" with head diameters of ½", ¾", 1" and 1¼", respectively. The heads 16 also vary in depth having lengths of 0.187 inch, 0.281 inch, 0.312 inch, and 0.312 inch, respectively, for the diameters listed here. The length of body portion 22 will be designed to position the weldment plate 12 where desired, typically with upper surface 14 flush with the surface 19 of wall 18.

Surface engaging portion 24 preferably comes to a point 25 so as to minimize the amount of weldment spacer/support that protrudes on surface 21. Accordingly, minimal accommodation will be necessary to treat the points 25 on wall 18. In fact, it is anticipated that the painting, papering or other treatment provided wall surface 21 will adequately cover the points 25. It is preferred that the length of body portion 22 will be adjustable. One such means can be the cutting of body portion 22 to the desired length to place weldment plate 12 flush with the designed wall surface 19 once concrete 17 is poured. To facilitate this cutting (or breaking), body 22 may be provided with scoring lines 40 at one or more conventional wall thicknesses/stud lengths so the point 25 may be maintained.

The material from which weldment plate spacer/support is made is selected from the group consisting of plastic, metal, and powdered metal. It is envisioned that a durable, tough plastic material such as nylon or polypropylene, possibly with glass or carbon fiber reinforcement, will be suitable for this application and provide the most cost effective means of solving this problem. It is, however, possible that for certain applications, the strength requirements will dictate that the weldment plate spacer/support 20 be manufactured from metal including but not limited to powdered metal. The spacer/support 20 of the present invention could be cast or machined from aluminum, from example.

Means 26 for attaching body portion 22 to weldment plate 11 comprises a plurality of fingers 30 (shown exemplarily as three in number) with portions 29 that snap in behind stud heads 16. As seen in FIGS. 2A and 2B, fingers 30 are equally spaced about the periphery of head securement 28. However, it is envisioned that as few as two and as many as six fingers could be utilized to effect attachment to head 16. If only two fingers 30 were utilized, they would have an extended peripheral span to stabilize their hold on head 16. It is preferred for stability reasons, that there be three or more fingers 30. The depth of head securement 28 will be sized to accommodate the length of stud head 16 and the diameter will similarly be properly sized to receive the particular diameter of stud head 16.

Figure 4:
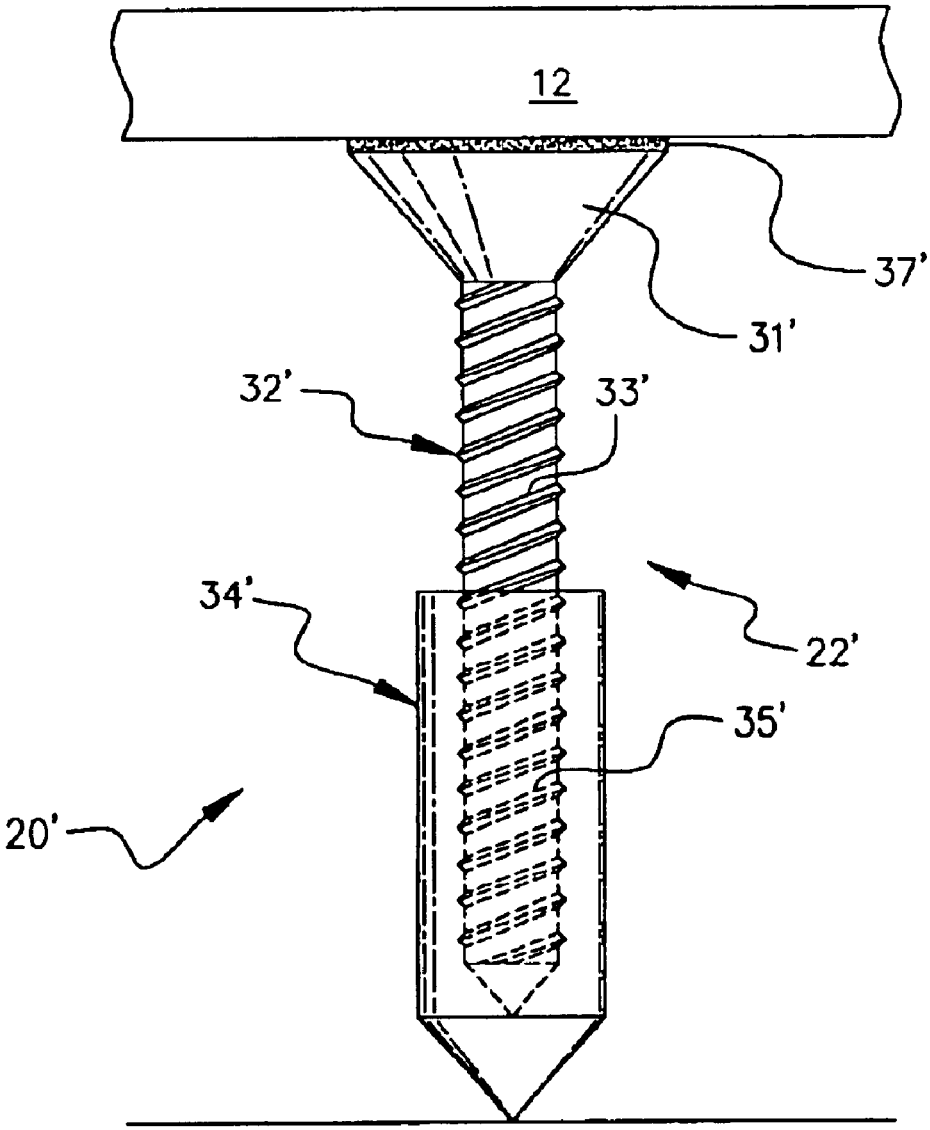
FIG. 4 is a second embodiment of the weldment spacer/support of the present invention for use with a weldment plate.

A second embodiment of weldment plate spacer/support is shown in FIG. 4 generally at 20'. In this embodiment, body portion 22' is formed by a first component 32' and a second component 34' that can be longitudinally moved with respect to each other to vary the length, as desired. This variation in length is effected by rotating one of the components 32', 34' with respect to the other. The complementarily engaged threads 33' and 35' will produce the desired variation in length. The head 31' of first component 32' is designed for attachment to a weldment plate 12 that has no projections. An adhesive, 37' such as LIQUID NAILS may be used to secure the spacer/support 20' to the surface 13 of weldment plate 12. A minimum of three spacer/supports 20' dispersed in a triangular pattern will be needed to assure stable placement of the weldment plate 12.

In use (FIG. 3), weldment plate spacer/supports 20 are attached to weldment plate 11 as by snapping finger portions 29 over projection heads 16. At least three such spacer supports 20 configured in a triangular pattern should be used to ensure stability. The length of spacer/supports 20 will have been previously adjusted to position the surface 14 at the desired reference plane with respect to upper surface 19 of concrete wall 18. The thusly equipped weldment plate 11 is situated inside concrete forms 41 on surface 43 which may, for example, be a plastic sheeting material, and concrete 17 poured into forms 41. Weldment plate spacer/supports 20 hold plates 11 in the desired position while the concrete 17 sets up. When the concrete 17 has properly set, tilt-up wall 18 can be uprighted and secured in position. The smallness of points 25 will have minimal/no effect on the surface treatment required to finish wall surface 21.

Various changes, alternatives and modifications will become apparent to one of ordinary skill in the art following a reading of the foregoing specification. For example, while the two component adjustable embodiment has been depicted only with the flat head design, it will be understood it can easily be adapted for use with the fingered securement head 28. It is intended that any such changes, alternatives and modifications as fall within the scope of the appended claims be considered part of the present invention.

We claim:

1. A device for supporting a weldment plate, which is used during formation of a poured concrete wall, the device comprising:

an elongate body portion having a length substantially equal to a thickness of the concrete wall, which is contemplated to be poured, minus a dimension of the weldment plate extending in a direction of the thickness of the concrete wall;

a surface engaging portion for contacting a surface on which the concrete wall will be poured and for supporting the weldment plate in a position appropriately spaced from that surface;

the length of said elongate body portion being adjustable;

said elongate body portion comprising two components which may be adjusted relative to each other to achieve the desired length;

said two components being threadably engaged and rotation of one component relative to a second component results in a change in the length of said elongate body portion; and means for attaching said elongate body portion to the weldment plate, wherein the device is capable of maintaining the weldment plate in a desired position when wet concrete is poured and sets up to form the concrete wall.

2. The device according to claim 1, wherein said means for attaching said elongate body portion to the weldment plate comprises an adhesive layer between said weldment plate and one of said components.

3. The device according to claim 1, wherein said surface engaging portion comprises a section which tapers to a point to minimize surface treatment of the concrete wall needed to accommodate said device.

4. The device according to claim 1, wherein a material for said device is selected from a group consisting of plastic, metal and powdered metal.

5. The device according to claim 1, wherein the weldment plate includes a plate member and projections extending from the plate member, said means for attaching said elongate body portion to the weldment plate further comprising means for securing said device to a head portion of the weldment projection.

6. The device according to claim 5, wherein the projections are Nelson studs welded to the nether side of the plate member and said means for securing said device to the head portion of the weldment projections comprising a plurality of fingers to capture the head portion of the Nelson stud securing said device thereto.

7. The device according to claim 6, wherein said plurality of fingers comprises at least two fingers with portions that snap behind the head portion of the weldment projection.

8. A device for supporting a weldment plate, which is used during formation of a poured concrete wall, said device comprising:

an elongate body portion having a length substantially equal to a thickness of the concrete wall, which is contemplated to be poured, minus a dimension of the weldment plate extending in a direction of the thickness of the concrete wall;

a surface engaging portion for contacting a surface on which the concrete wall will be poured and for supporting the weldment plate in a position appropriately spaced from that surface;

the length of said elongate body portion being adjustable;

said elongate body portion comprising two components which may be adjusted relative to each other to achieve the desired length; and means for attaching said elongate body portion to the weldment plate, said means for attaching comprising an adhesive layer between said weldment plate and one of said components, wherein the device is capable of maintaining the weldment plate in a desired position when wet concrete is poured and sets up to form the concrete wall.

9. The device according to claim 8, wherein said two components are threadably engaged and rotation of one component relative to a second component results in a change in the length of said body portion.

10. The device according to claim 8, wherein said surface engaging portion comprises a section which tapers to a point to minimize surface treatment of the concrete wall needed to accommodate said device.

11. The device according to claim 8, wherein a material for said device is selected from a group consisting of plastic, metal and powdered metal.

12. A device for supporting a weldment plate, which is used during formation of a poured concrete wall, the weldment plate having a plate member and projections extending from the plate member with a head portion at each projection's end opposite the plate member, the weldment plate projections being Nelson studs welded to the nether side of the plate member, said device comprising:

an elongate body portion having a length substantially equal to a thickness of the concrete wall, which is contemplated to be poured, minus a dimension of the weldment plate extending in a direction of the thickness of the concrete wall;

a surface engaging portion for contacting a surface on which the concrete wall will be poured and for supporting the weldment plate in a position appropriately spaced from that surface;

means for attaching said elongate body portion to the head portion; and said means for securing said device to the head portion of the weldment projection further comprising a plurality of fingers to capture the head portion of the Nelson stud securing said device thereto, wherein the device is capable of maintaining the weldment plate in a desired position when wet concrete is poured and sets up to form the concrete wall.

13. The device according to claim 12, wherein said plurality of fingers comprises at least two fingers with portions that snap behind the head portion of the weldment projection.

14. The device according to claim 13, wherein said length of said elongate body portion is adjustable.

15. The device according to claim 14, wherein said length is adjustable by manually removing excess length.

16. The device according to claim 14, wherein said elongate body portion comprises two components which may be adjusted relative to each other to achieve the desired length.

17. The device according to claim 15, wherein said two components are threadably engaged and rotation of one component relative to a second component results in a change in the length of said elongate body portion.

18. The device according to claim 12, wherein said surface engaging portion comprises a section which tapers to a point to minimize surface treatment of the concrete wall needed to accommodate said device.

19. The device according to claim 12, wherein a material for said device is selected from a group consisting of plastic, metal an powdered metal.

20. A device for supporting a weldment plate, which is used during formation of a poured concrete wall, said device comprising:

an elongate body portion having a length substantially equal to a thickness of the concrete wall, which is contemplated to be poured, minus a dimension of the weldment plate extending in a direction of the thickness of the concrete wall;

means for attaching said elongate body portion to the weldment plate; and a surface engaging portion for contacting a surface on which the concrete wall will be poured and for supporting the weldment plate in a position appropriately spaced from that surface, wherein when the weldment plate further includes projections extending from the plate member with a head portion at each projection's end opposite the plate members the projections being Nelson studs welded to the nether side of the plate member, said means for securing said device to the weldment plate further includes means for securing said device to the head portion of the weldment projections, and said means for securing said device to the head portion further comprises a plurality of fingers to capture the head portion of the Nelson stud securing said device thereto, and wherein the device is capable of maintaining the weldment plate in a desired position when wet concrete is poured and sets up to form the concrete wall.

21. The device of claim 20, wherein said plurality comprises at least two fingers with portions that snap behind the head portion of the weldment projection.

22. The device of claim 20, wherein said length of said elongate body portion is adjustable.

23. The device of claim 22, wherein said length is adjustable by manually removing excess length.

24. The device of claim 20, wherein said elongate body portion comprises two components which may be adjusted relative to each other to achieve the desired length.

25. The device of claim 24, wherein said two components are threadably engaged and rotation of one component relative to a second component results in a change in the length of said elongate body portion.

26. The device of claim 24, wherein said means for attaching said elongate body portion to the weldment plate comprises an adhesive layer between said weldment plate and one of said components.

27. The device of claim 20, wherein said surface engaging portion comprises a section which tapers to a point to minimize surface treatment of the concrete wall needed to accommodate said device.

28. The device of claim 20, wherein a material for said device is selected from a group consisting of plastic, metal and powdered metal.

* * * * *

UNITED STATES PATENT AND TRADEMARK OFFICE

CERTIFICATE OF CORRECTION

PATENT NO. : 6,823,635 B2
DATED : November 30, 2004
INVENTOR(S) : Todd M. Schulze et al.

It is certified that error appears in the above-identified patent and that said Letters Patent is hereby corrected as shown below:

Column 6,
Line 1, replace "The device according to claim 15" with -- The device according to claim 16 --.
Line 48, replace "The device of claim 20" with -- The device of claim 22 --.

Signed and Sealed this

Fifteenth Day of March, 2005

JON W. DUDAS
*Director of the United States Patent and Trademark Office*